US006026060A

United States Patent [19]

Rothschild et al.

[11] Patent Number: 6,026,060

[45] Date of Patent: Feb. 15, 2000

[54] VEHICLE STICKER

[75] Inventors: Alan W. Rothschild, Cazenovia; James P. Romano; Richard A. Bozogian, both of Syracuse, all of N.Y.

[73] Assignee: Rothschild Technology, L.L.C., Syracuse, N.Y.

[21] Appl. No.: 09/084,339

[22] Filed: May 26, 1998

[51] Int. Cl.[7] ..... G04F 8/00

[52] U.S. Cl. ..... 368/10; 368/107; 368/108

[58] Field of Search ..... 368/71, 72, 10, 368/3, 62, 76–78, 223–235

[56] References Cited

U.S. PATENT DOCUMENTS

| | | | |
|---|---|---|---|
| 1,432,566 | 10/1922 | Metcalfe | 368/71 |
| 1,850,184 | 3/1932 | Spainhower | 368/71 |
| 3,106,817 | 10/1963 | Ducommun | 368/71 |
| 4,370,063 | 1/1983 | Lee | 368/71 |
| 4,408,557 | 10/1983 | Bradley et al. | 116/206 |
| 4,730,285 | 3/1988 | Lie | 368/90 |
| 5,006,829 | 4/1991 | Miyamoto et al. | 340/459 |
| 5,058,088 | 10/1991 | Haas et al. | 368/327 |
| 5,105,179 | 4/1992 | Smith | 340/468 |
| 5,132,666 | 7/1992 | Fahs | 340/468 |
| 5,182,212 | 1/1993 | Jalinski | 436/2 |
| 5,285,425 | 2/1994 | Morisawa | 368/10 |
| 5,432,496 | 7/1995 | Lin | 340/468 |
| 5,446,705 | 8/1995 | Haas et al. | 368/327 |
| 5,497,572 | 3/1996 | Hoffman | 40/544 |
| 5,555,223 | 9/1996 | Barainsky | 368/10 |

*Primary Examiner*—Bernard Roskoski
*Attorney, Agent, or Firm*—Trapani & Molldrem

[57] ABSTRACT

A vehicle sticker for monitoring a time-period associated with a motor vehicle, comprises an electronic timer, first and second indicator devices, and some mechanism for affixing the sticker to the vehicle. The timer is configured to time the time-period associated with the vehicle and to generate an "impending expiration" signal and an "expiration" signal. The first indicator device is coupled to the timer, and is configured to indicate an "impending expiration" or a "renewal" warning in response to the impending expiration signal. The second indicator device is also coupled to the timer, and is configured to indicate the expiration of the time-period in response to the expiration signal. The affixing mechanism must hold the sticker on the vehicle, in such a position that the impending expiration indication is directed to someone inside the vehicle and the expiration indication is directed to someone outside the vehicle.

13 Claims, 3 Drawing Sheets

VEHICLE STICKER

BACKGROUND OF THE INVENTION

1. Technical Field

The present invention relates generally to a vehicle sticker that indicates a particular time-period associated with a vehicle to which such sticker is applied. Such devices may include automobile registration and inspection stickers. The present invention relates more specifically to a vehicle sticker that can monitor the time-period and signal both the impending expiration and expiration thereof.

2. Background Art

To anyone who owns or operates an automobile, or other regulated motor vehicle, there is the responsibility to ensure that such vehicle is titled, licensed, registered, and/or inspected. In the case of vehicle licensure, registration and inspection, a particular time-period may be assigned by a regulatory agency (e.g., a state department of motor vehicles), whereupon its expiration, a renewal or re-inspection is required.

Such regulatory agencies have utilized stickers, plates and tags to indicate on the vehicle, the licensure, registration and inspection status of the vehicle. One drawback of such devices is that they are passive, thus requiring vigilance on the part of the owner/operator and policing authorities to monitor the status of the vehicle. In many cases, the vigilance necessary to ensure the currentness of vehicle status is not exercised. This is due, in part, to the busy and sometimes hectic lives we live. Therefore, there is a need to prompt a vehicle owner or operator, and even the policing authority, to note or monitor the licensure, registration and/or inspection status of a regulated motor vehicle.

The concept of transforming traditionally passive information devices for vehicles, such as signs or license plates, into active devices is not new. For example, U.S. Pat. Nos. 5,432,496 to Lin, 5,132,666 to Fahs, 5,105,179 to Smith, and 5,006,829 to Miyamoto et al., all disclose various electronic display devices for automobiles. The devices in the Lin, Fahs and Smith patents display information outside the vehicle, and the device in the Miyamoto et al. patent displays information inside the vehicle. None of these patents, however, perform a dual function of displaying information both inside and outside the vehicle, where such information concerns a particular time-frame or status associated with the vehicle.

U.S. Pat. No. 5,105,179 to Smith is specifically directed to an electronic automobile license plate, which also provides an indication that the vehicle registration has expired. However, the device proposed in Smith does not communicate a visual or an audible signal or indication to someone inside the vehicle, to warn of an impending expiration of the registration.

The concept of monitoring a time-period associated with a motor vehicle is also not new. For example, U.S. Pat. Nos. 5,285,425 to Morisawa and 4,730,285 to Lie disclose devices which monitor and display parking time. However, both such devices are intended to be fitted in a vehicle so as to be visible only from the outside the vehicle. No provision is made to display information both inside and outside of the vehicle.

In U.S. Pat. No. 5,006,829 to Miyamoto et al. (introduced above), the proposed system monitors the mileage of a vehicle, and alerts the operator of an impending scheduled maintenance based on such mileage. However, no provision is made to indicate, from outside the vehicle, that the maintenance period for the vehicle has expired.

OBJECTS AND SUMMARY OF THE INVENTION

It is therefore an object of the present invention to provide a vehicle sticker that avoids the aforementioned problems and limitations associated with the prior art.

It is another object of the present invention to provide a vehicle sticker that monitors a time-period associated with a motor vehicle and signals both the impending expiration and expiration of such time-period.

It is a further object of the present invention to provide a vehicle sticker that indicates the impending expiration to someone inside the vehicle and the expiration to someone outside the vehicle.

It is yet another object of the present invention to provide a vehicle sticker that warns the vehicle operator that he or she must register and/or inspect the vehicle and warns policing authorities of an expired registration or inspection period.

It is yet a further object of the present invention to provide an electronic vehicle sticker that is relatively inexpensive, making it economically feasible for widespread use.

It is still another object of the present invention to provide a vehicle sticker that is relatively small in size, such that it can be easily affixed to the window of a vehicle.

It is still a further object of the present invention to provide an electronic vehicle sticker having relatively low power consumption, such that a single battery can be used over the life of the sticker.

It is yet still another object of the present invention to provide a vehicle sticker that communicates clear and conspicuous "impending expiration" and "expiration" messages or signals.

It is yet still a further object of the present invention to provide a vehicle sticker having a timing function, the accuracy of which is not adversely affected over a wide temperature range.

These and other objects are attained in accordance with the present invention, wherein there is provided a vehicle sticker for monitoring a time-period associated with a motor vehicle. The sticker comprises a timer, an indicator, and some mechanism to affix the sticker to a vehicle. The timer is configured to time the time-period associated with the vehicle. The indicator is operatively coupled to the timer, and is configured to indicate an impending expiration of the time-period to someone inside the vehicle and to indicate the expiration of the time-period to someone outside the vehicle. The affixing mechanism must hold the sticker on the vehicle, in such a position that the indication of impending expiration is directed to someone inside the vehicle and the indication of expiration is directed to someone outside the vehicle.

In the preferred embodiment, the vehicle sticker is an electronic vehicle sticker, comprising an electronic timer, first and second electronic indicator devices, and some mechanism for affixing the sticker to the vehicle. The electronic timer is configured to time the time-period associated with the vehicle and to generate an "impending expiration" signal and an "expiration" signal. The first indicator device is coupled to the timer, and is configured to indicate the impending expiration of the time-period in response to the impending expiration signal. The second indicator device is also coupled to the timer, and is configured to indicate the expiration of the time-period in response to the expiration signal.

A method of monitoring a time-period associated with a motor vehicle, using a vehicle sticker, is also contemplated by the present invention. One such method may comprise the steps of: (a) affixing the sticker to a window of the vehicle; (b) timing the time-period associated with the vehicle using a timer which is a part of the sticker; (c) indicating to someone inside the vehicle of the impending expiration of the time-period; and (d) indicating to someone outside the vehicle of the expiration of the time-period.

Another method of the present invention may include the use of an electronic vehicle sticker having an electronic timer and an electronic indicator device. The method comprises the steps of: (a) affixing the sticker to a window of the vehicle such that the indicator device directs a first visual signal to the inside of the vehicle and a second visual signal to the outside of the vehicle; (b) timing a time-period associated with the vehicle with the electronic timer; (c) generating a first electrical signal prior to the expiration of the time-period; (d) generating a second electrical signal upon expiration of the time-period; (e) generating the first visual signal in response to the first electrical signal, to alert someone inside of the vehicle of the impending expiration; and (f) generating the second visual signal in response to the second electrical signal, to alert someone outside the vehicle of the expiration.

BRIEF DESCRIPTION OF THE DRAWING

Further objects of the present invention will become apparent from the following description of the preferred embodiment with reference to the accompanying drawing, in which.

DETAILED DESCRIPTION OF THE PREFERRED EMBODIMENT

Figure 1:
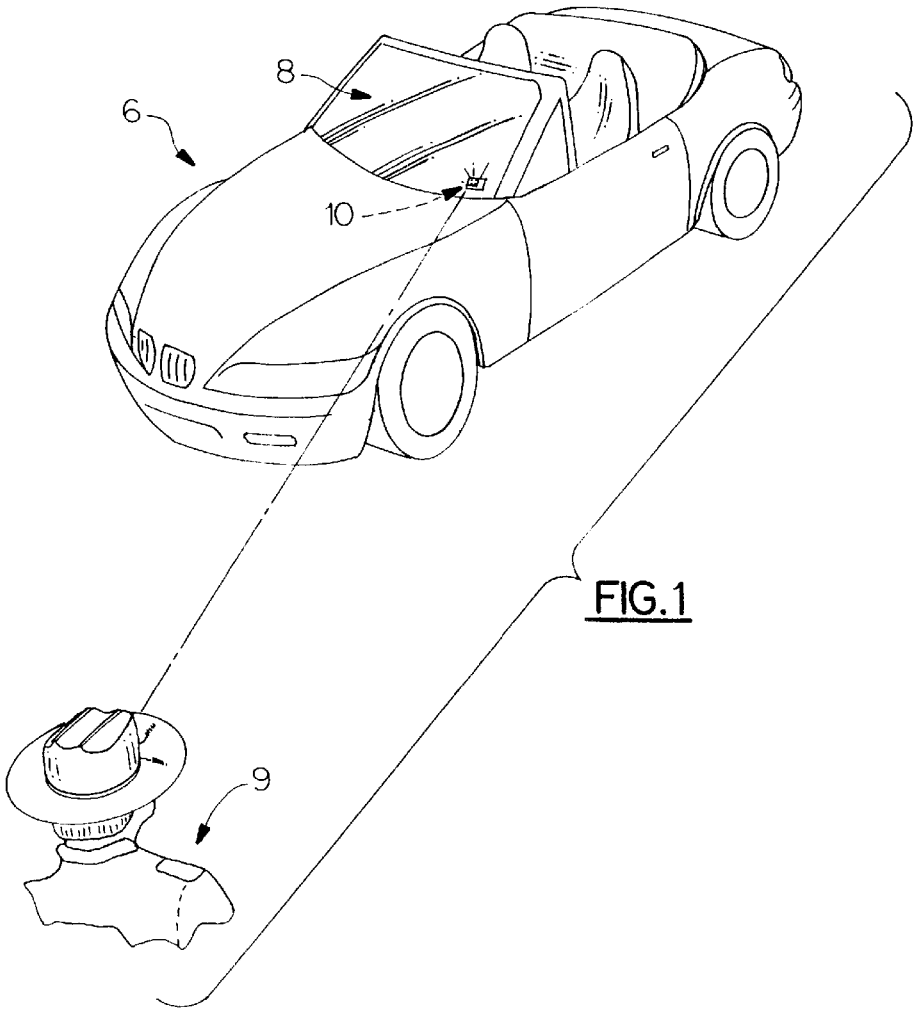
FIG. 1 is a perspective view, illustrating the operational environment of a vehicle sticker in accordance with the present invention.

With reference to FIG. 1, there is shown a perspective view illustrating the operational environment of a vehicle sticker 10, constructed in accordance with the present invention. In FIG. 1, sticker 10 is employed to monitor a particular time-period associated with an automobile 6, such as the registration period for automobile 6. Sticker 10 is affixed to the inside surface a windshield 8 of automobile 6, by means of an adhesive or double-sided foam tape. Sticker 10 includes an electronic indicator, such as a light emitting diode (LED) or liquid crystal display (LCD), which, when energized, is visible through windshield 8. The indicator provides a visual signal to, e.g., a highway patrol person 9 that a time-period associated with the vehicle (e.g., a registration period) has expired. If the registration of vehicle 6 has expired, sticker 10 would visually indicate this expiration by, e.g., displaying a message or blinking an LED.

Figure 2:
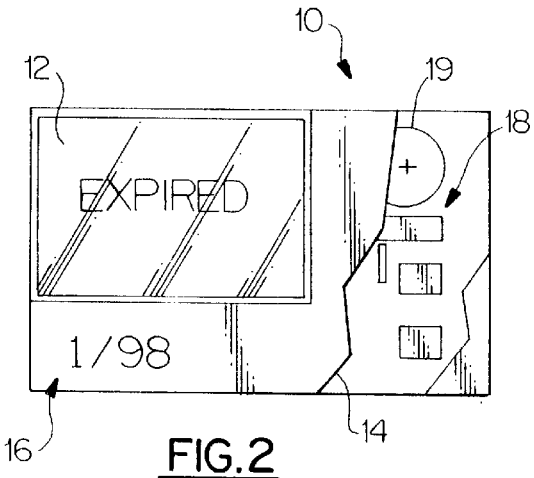
FIG. 2 is a front elevation view of one embodiment of a vehicle sticker according to the present invention.
Figure 3:
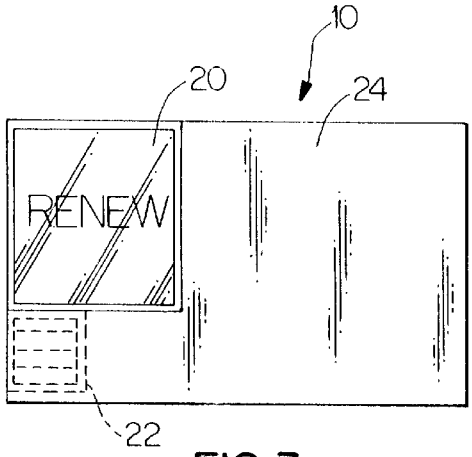
FIG. 3 is a rear elevation view of the vehicle sticker shown in FIG. 2.

Referring now to FIGS. 2 and 3, there is shown front and rear elevation views, respectively, of sticker 10. As shown in FIG. 2, sticker 10 includes a front indicator device 12, which is intended to indicate an expired condition upon expiration of the time-period being monitored by sticker 10. The front side of sticker 10, as shown in FIG. 2, is affixed to the inside surface of a window or windshield of the vehicle being monitored. Sticker 10 may include a skin or panel 14 (partially broken away in FIG. 2). Panel 14 contains an adhesive coating with sufficient bonding strength to hold sticker 10 to the window during the period to be timed. Traditional indicia 16, such as registration or inspection dates, may be imprinted on panel 14 for viewing in the usual manner. Panel 14 is partially broken away in FIG. 2 to show the presence of internal circuitry 18 (described below with reference to FIG. 5) and a battery 19. Indicator device 12 may be centered on the front of sticker 10 in order to provide a uniform adhesive area surrounding indicator device 12.

As shown in FIG. 3, sticker 10 includes a rear indicator device 20, which is intended to indicate an impending expiration of the time-period being monitored by sticker 10. Such an indication may include, e.g., a blinking LED, a message to renew a registration or obtain an inspection, or a display of the time remaining before registration or inspection is due. The rear side of sticker 10, as shown in FIG. 3, faces the operator of the motor vehicle when sticker 10 is affixed to the windshield. Sticker 10 may include, in addition to or in place of indicator 20, a sound transducer or speaker 22, which produces an audible signal to alert the vehicle operator of the impending expiration. As shown in FIG. 3, the rear side of sticker 10 may include a skin or panel 24 to cover the internal components of the sticker.

Figure 4:
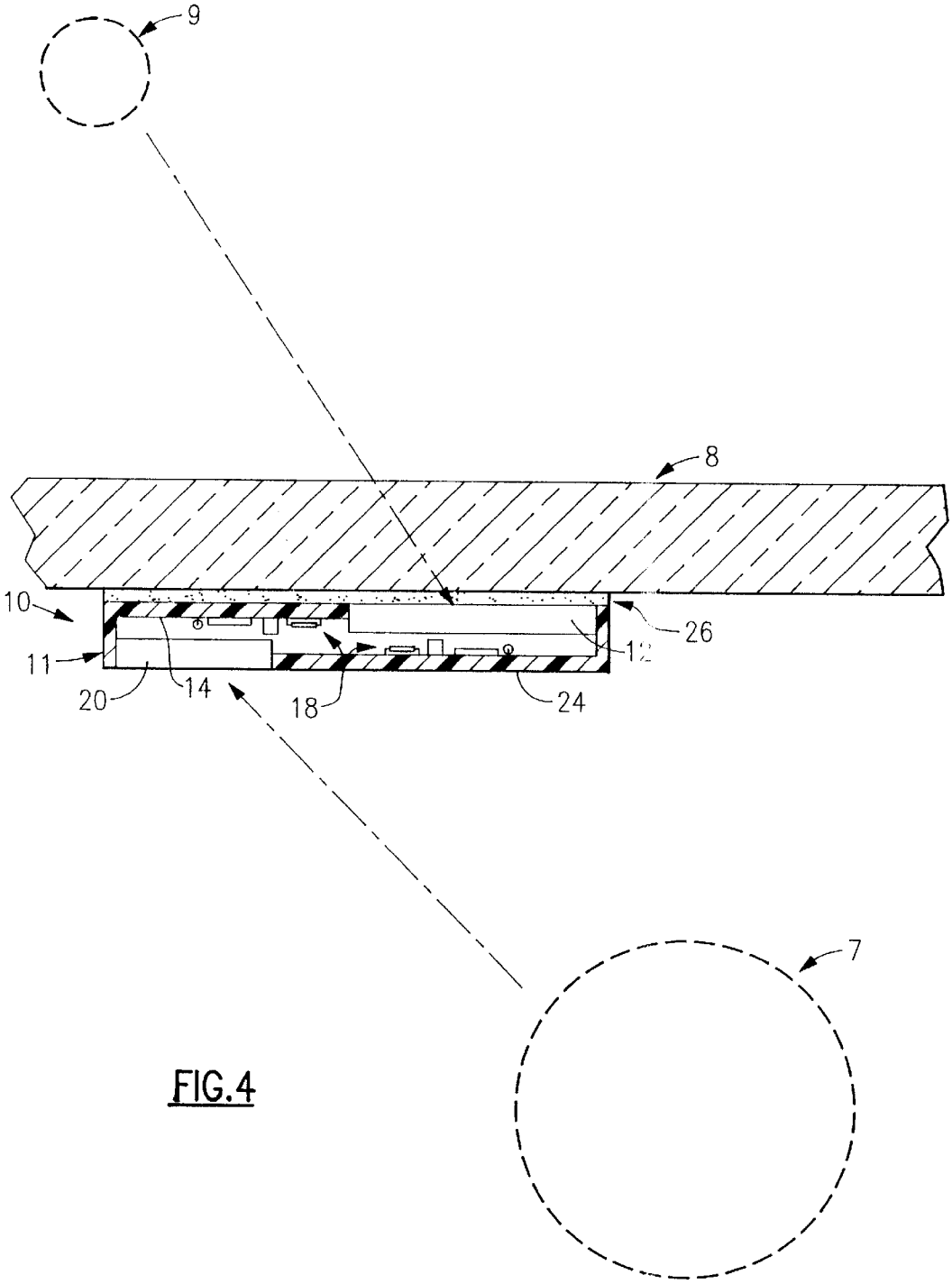
FIG. 4 is a cross-sectional view of the vehicle sticker affixed to a windshield, and includes schematic features to illustrate the operation of the vehicle sticker.

Referring now to FIG. 4, there is shown a cross-sectional view of sticker 10 affixed to windshield 8. FIG. 4 also illustrates the operation of sticker 10. In FIG. 4, sticker 10 is affixed to windshield 8 by means of a piece of double-sided foam tape 26. The piece of tape is cut to match, approximately, the surface area of panel 14 in order to maximize the adherence of sticker 10 to windshield 8. In addition to an adhesive coating or double-sided tape, any suitable means for affixing sticker 10 to a vehicle surface may be used.

As shown in FIG. 4, sticker 10 comprises a housing 11, and panels 14 and 24 are formed integrally therewith. Alternatively, panels 14 and 24 may be separate sheets fastened to each other at the edges, to form a pocket in which circuitry 18 is housed. In another embodiment, circuitry 18 may be mounted on a single mount or circuit board and left exposed (i.e., no panels or housing). In the latter case, if double-sided tape is used, it can be applied directly to the circuit board.

As illustrated in FIG. 4, a vehicle operator 7 has a direct line-of-sight to indicator device 20, and patrol person 9 has a direct line-of-sight to indicator device 12. In operation, indicator 20 directs an indication or message to operator 7 inside the vehicle, alerting operator 7 of an impending expiration or reminding operator 7 to renew. Indicator 12 directs an indication or message to patrol person 9 outside the vehicle, alerting person 9 of an expired status of the vehicle. In this description, and in the claims, an indication of "impending expiration" is meant to include, but is not limited to, an indication or message to renew, a display of time remaining, a flashing renewal date, or simply a blinking LED or display.

Figure 5:
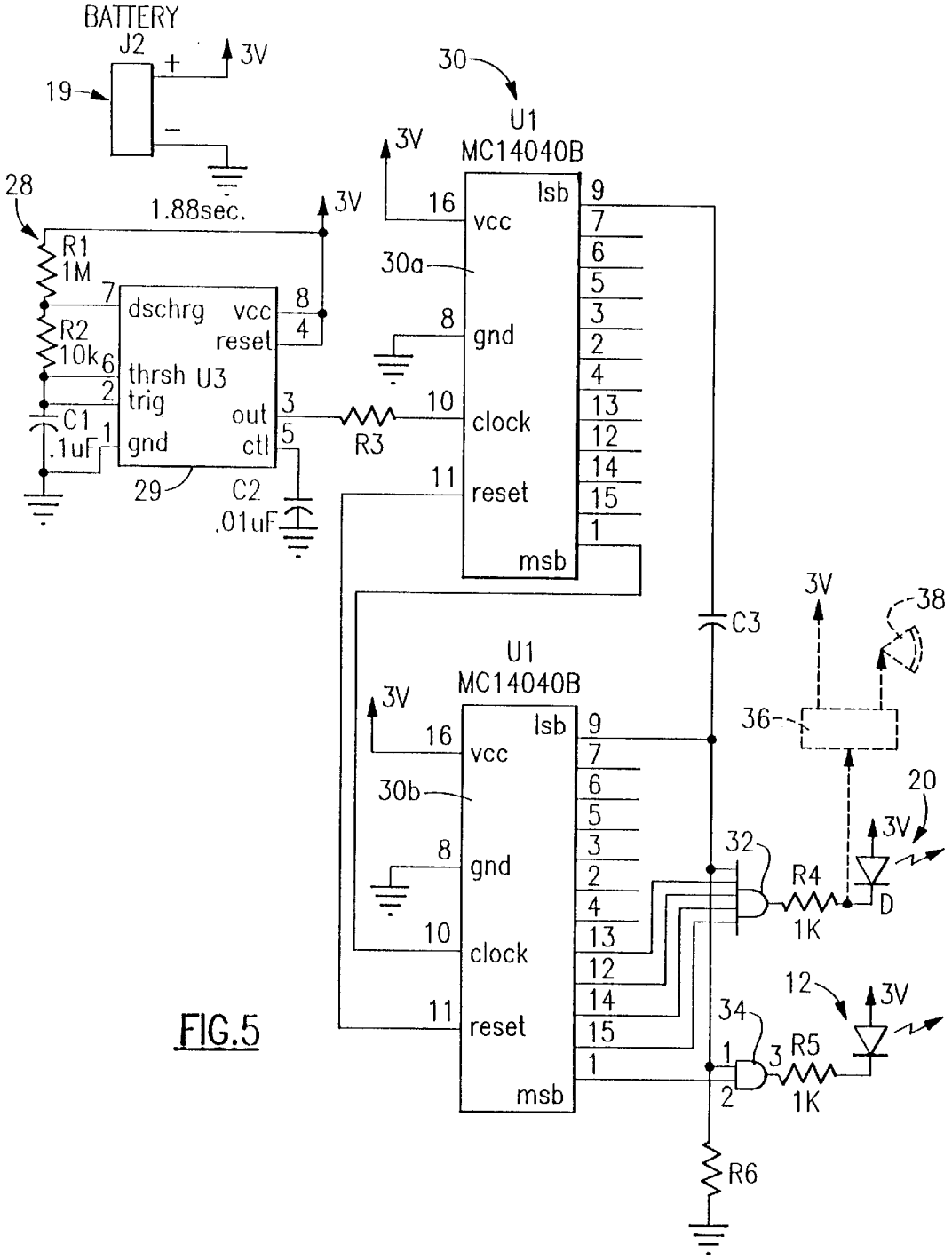
FIG. 5 is a schematic diagram of the electronic circuitry of the vehicle sticker of FIGS. 2 and 3.

Referring now to FIG. 5, the details of the electrical components and circuitry of sticker 10 will now be described. As shown, sticker 10 includes indicator devices 12 and 20 which are implemented here as LEDs. A lithium or silver oxide button cell battery 19 is also included, which is preferably no larger than ½ inch in diameter. Sticker 10 further includes an electronic timer, which is implemented here with a pulse generator circuit 28 and a two-stage binary counter 30. Pulse generator circuit 28 may utilize a Texas Instruments CMOS TLC555C timer chip 29. The TLC555C chip is desirable because of its low quiescent current draw (i.e., 15–100 microamps), long duration timing capability, and low cost. Timer chip 29 is configured as an astable multivibrator (i.e., a free running pulse generator).

Pulse generator circuit 28 also includes resistors R1, R2 and capacitors C1, C2. The sum of resistors R1, R2, and the value of capacitor C1, determine the pulse rate of circuit 28. The ratio of resistors R1, R2 determines the pulse width. A wide pulse width might be desirable if the indicator devices are, e.g., TN LCDs, whereas a narrow pulse might be better for conserving power when LEDs are used. As indicated in FIG. 5, circuit 28 is powered by battery 19.

The output of pulse generator circuit 28 is a series of pulses at a predetermined pulse rate and pulse width. This output appears at pin 3 of chip 29. The output is coupled through a resistor R3 to the clock input of a first counter 30*a* of two-stage counter 30. Counter 30 is a 24-bit counter comprising two 12 bit counters 30*a* and 30*b*. Counters 30*a* and 30*b* are standard binary counters (e.g., Motorola MC14040B chips) which increment a binary count each time a pulse is applied to their respective clock inputs (pins 10). Since each input pulse occurs at a predetermined interval (e.g., 2 seconds), a real time-period can be monitored. Counters 30*a* and 30*b* are asynchronously connected, in that the most significant bit (MSB) output of counter 30*a* (pin 1) is connected to the clock input (pin 10) of counter 30*b*. Counters 30*a* and 30*b* are each powered by battery 19.

As shown in FIG. 5, the 20th, 21st, 22nd, and 23rd outputs of counter 30 (pins 13, 12, 14 and 15 of counter 30*b*) are connected to four inputs, respectively, of a five-input AND gate 32. The least significant bit (LSB) output of counter 30 (pin 9 of counter 30*a*) is coupled through a capacitor C3 to the fifth input of AND gate 32. The output of gate 32 is coupled through a resistor R4 to indicator 20 which is an LED. The LSB output of counter 30 (pin 9 of counter 30*a*) is also coupled through capacitor C3 to the first input of an AND gate 34. The most significant bit (MSB) output of counter 30 (pin 1 of counter 30*b*) is connected to the second input of AND gate 34. The output of gate 34 is coupled through a resistor R5 to indicator 12, which is also an LED. LEDs 20 and 12 are each powered by battery 19. A resistor R6 is connected between the first input of gate 34 and ground. Resistor R6 and capacitor C3 form an RC circuit with a predetermined time constant. Most of the circuit components shown in FIG. 5 can be implemented on a single chip, as an Application Specific Integrated Circuit (ASIC).

In setting up counter 30, a predetermined initial count number (e.g., 0) and a final count number are determined for counter 30. The number of binary counts between the initial and final count numbers, and the pulse rate interval (PRI) of the pulses from generator 28, establish a counting time (or timing period) for counter 30. This timing period is set to correspond to the time-period to be timed by sticker 10 (e.g., registration or inspection period). The time period is set when sticker 10 is manufactured.

Counter 30 is initially configured with all bits set to zero. In this example, pulse generator 28 is configured to have a PRI of 1.88 seconds. Counter 30 is incremented upon receipt of each pulse from generator 28. When the count of 15,728,640 is reached, 342.2 days will have elapsed (1.88 seconds× 15,728,640 counts). Upon reaching 15,728,640 counts, the 20th, 21st, 22nd, and 23rd outputs of counter 30 (i.e., pins 13, 12, 14 and 15 of counter 30*b*) will each have changed to a binary 1 or HIGH state. These four HIGH outputs are applied to the corresponding four inputs of AND gate 32 and enable the remaining input of gate 32. This remaining input is coupled to the LSB output of counter 30. The LSB output will rise high every other input pulse from circuit 28, or every 3.76 seconds, causing LED 20 to blink. Since the LSB output is capacitively coupled to gate 32, the output of gate 32 will force LED 20 "ON" for the duration of a time constant established by capacitor C3 and resistor R6. The time constant is chosen to produce a short, but noticeable blink of the LED. This makes the indication more conspicuous and extends battery life.

From the above description, it is understood that a blinking warning or indication is produced at indicator 20, 22 days (365–342.2) before the expiration of the one-year period being timed by the electronic timer (generator 28 and counter 30).

The binary state of the MSB output (pin 1 of counter 30*b*) will be changed to a HIGH level after 16,777,216 pulses. At a PRI of 1.88 seconds, this count will take 365.05 days. As the MSB output changes to a HIGH state, it enables AND gate 34, and allows the LSB output (pin 9 of counter 30*a*) to control the operation of LED 12 in the same manner as LED 20. Thus, a blinking indication is produced at LED 12 upon expiration of a time-period of 365 days.

Both LEDs, 12 and 20, will continue to blink until sticker 10 is reprogrammed or replaced, or until battery 19 can no longer support the device. It is estimated that, with a 500 milliamp-hour battery, sticker 10 could time periods of nearly two years.

The present invention is not limited to a blinking mode of operation. AND gates 32 and 34 can be removed from the circuit in FIG. 5 so that LEDs 20 and 12 operate in a continuous mode, i.e., continuously off during timing and continuously on after their associated time-periods (e.g., 342.2/365.05 days) have been reached. The present invention is not limited to LED indicators. Indicators 12 and 20 could be LCDs, which may provide an alphanumeric message.

In one such LCD approach, TN-type LCDs may be used. TN-type LCDs include a clear plastic or glass display panel containing an electro-sensitive display media. If a voltage is applied to the display panel, the media turns dark. If the voltage is removed, the media turns clear. A background is applied to the rear surface of the display panel and contains, e.g., an "EXPIRED" or "RENEW" message, or is colored red. When a voltage is applied to the panel, the media obscures the message or color, and when the voltage is removed, the media reveals the message or color. In this embodiment, the counter may have to be pre-set differently then described with respect to the LED implementation.

The present invention is not limited to an electronic indicator for indicating an expired or impending expiration condition. Any means for indicating such conditions can be employed if some electrical transducer or interface can be devised. For example, the dye or chemical indicators disclosed in U.S. Pat. Nos. 4,408,557 to Bradley et al., 5,058,088 to Haas et al.; 5,182,212 to Jalinski; and 5,446,705 to Haas et al., may be employed with a transducer that causes the chemicals or dye to migrate upon receipt of a control signal.

Further, the present invention is not limited to visual means for indicating an impending expiration or expired condition. An audible signal may be employed, such as a speaker emitting a tone, or the sounding of a horn or buzzer. For example, in FIG. 5, a driver circuit 36 (in dashed lines)

may be added between resistor R4 and LED 20. A sound transducer 38, such as a speaker or horn, is connected to the output of driver 36. Driver circuit 36 is powered by battery 19. Driver circuit 36 could be configured to produce, e.g., a periodic tone or a combination of tones.

While the preferred embodiment of the invention has been particularly described in the specification and illustrated in the drawing, it should be understood that the invention is not so limited. Many modifications, equivalents, and adaptations of the invention will become apparent to those skilled in the art without departing from the spirit and scope of the invention as defined in the appended claims.

What is claimed is:

1. A method of monitoring a time-period associated with a motor vehicle using a vehicle sticker which includes a timer and an indicator, said method comprising the steps of:

(a) affixing said sticker to a window of the vehicle;

(b) timing the time-period associated with the vehicle using the timer of said sticker;

(c) indicating to someone inside the vehicle of the impending expiration of the time-period; and (d) indicating through the window to someone outside the vehicle of the expiration of the time-period, using the indicator of said sticker.

2. The method of claim 1, wherein said step (c) is performed by using the indicator of said sticker.

3. The method of claim 1, wherein said step (c) is performed by using a second indicator associated with said sticker.

4. The method of claim 1, wherein said timer is an electronic timer.

5. The method of claim 1, wherein said step (c) includes indicating the impending expiration by audible signal.

6. The method of claim 1, wherein said step (a) includes affixing said sticker to the window with double-sided tape.

7. The method of claim 1, wherein said timer is a battery operated electronic timer.

8. The method of claim 1, wherein the indicator of said sticker is an LCD.

9. The method of claim 1, wherein the indicator of said sticker is an LED.

10. The method of claim 1, wherein said step (d) includes causing the indicator to blink on and off in a periodic manner.

11. The method of claim 1, wherein said sticker further includes a second indicator, and wherein said step (c) includes indicating with the second indicator and causing the second indicator to blink on and off in a periodic manner.

12. The method of claim 1, wherein said step (c) includes indicating with the indicator and causing the indicator to blink on and off in a periodic manner.

13. A method of monitoring a time-period associated with a motor vehicle using a vehicle sticker which includes an electronic timer and an electronic indicator means, the indicator means being configured to generate first and second visual signals, said method comprising the steps of:

(a) affixing the sticker to a window of the vehicle such that the indicator means directs the first visual signal to the inside of the vehicle and directs the second visual signal through the window to the outside of the vehicle;

(b) timing the time-period associated with the vehicle using the electronic timer of the sticker;

(c) generating the first visual signal from the indicator means to alert someone inside the vehicle of the impending expiration of the time-period; and (d) generating the second visual signal from the indicator means and directing said second signal through the window to alert someone outside the vehicle of the expiration of the time-period.

* * * * *